US007188562B2

(12) United States Patent
Hansen et al.

(10) Patent No.: US 7,188,562 B2
(45) Date of Patent: Mar. 13, 2007

(54) WATER-HYDRAULIC MACHINE

(75) Inventors: Ove Thorbøl Hansen, Nordborg (DK); Palle Olsen, Nordborg (DK); Lars Martensen, Sønderborg (DK); Erik Haugaard, Graasten (DK)

(73) Assignee: Danfoss A/S, Nordborg (DK)

( * ) Notice: Subject to any disclaimer, the term of this patent is extended or adjusted under 35 U.S.C. 154(b) by 326 days.

(21) Appl. No.: 10/446,360

(22) Filed: May 28, 2003

(65) Prior Publication Data

US 2003/0221549 A1 Dec. 4, 2003

(30) Foreign Application Priority Data

May 28, 2002 (DE) ..... 102 23 844

(51) Int. Cl.
*F01B 3/02* (2006.01)
*F04B 1/20* (2006.01)

(52) U.S. Cl. ..... 92/71

(58) Field of Classification Search ..... 92/71
See application file for complete search history.

(56) References Cited

U.S. PATENT DOCUMENTS 5,100,565 A 3/1992 Fujiwara et al.
5,288,556 A 2/1994 Lemelson
5,722,312 A 3/1998 Kristensen
5,762,477 A * 6/1998 Jepsen et al. ..... 92/71
5,806,557 A 9/1998 Helge
5,813,315 A * 9/1998 Kristensen et al. ..... 92/71
5,868,061 A * 2/1999 Hansen et al. ..... 92/71
5,873,657 A 2/1999 Lee
6,000,316 A * 12/1999 Moller et al. ..... 92/71
6,025,062 A 2/2000 Krenkel et al.
6,405,634 B1 * 6/2002 Hansen ..... 92/71
6,581,507 B2 * 6/2003 Mizutani et al. ..... 92/71
6,582,200 B2 * 6/2003 Kato et al. ..... 92/71
6,584,886 B2 * 7/2003 Sugiura et al. ..... 92/71
6,589,021 B2 * 7/2003 Kato et al. ..... 92/71
6,740,393 B1 * 5/2004 Massler et al. ..... 428/216

FOREIGN PATENT DOCUMENTS

EP 0861922 A1 9/1998

* cited by examiner

*Primary Examiner*—Thomas E. Lazo
(74) *Attorney, Agent, or Firm*—McCormick, Paulding & Huber LLP

(57) ABSTRACT

The invention concerns a water-hydraulic machine with at least two mutually movable parts, of which one has a surface of a plastic material with friction-reducing properties. In such a machine it is desired to enable the use of demineralised water. For this purpose, it is ensured that a layer of a carbon-containing material is arranged between the plastics material and the other part.

17 Claims, 3 Drawing Sheets

WATER-HYDRAULIC MACHINE

CROSS-REFERENCE TO RELATED APPLICATIONS

This application is entitled to the benefit of and incorporates by reference essential subject matter disclosed in German Patent Application No. 102 23 844.8 filed on May 28, 2002.

FIELD OF THE INVENTION

The invention concerns a water-hydraulic machine with at least two mutually movable parts, of which one has a surface of a plastic material with friction-reducing properties.

BACKGROUND OF THE INVENTION

A water-hydraulic machine of this kind is known from the "Nessie" project of Danfoss A/S, Nordborg, Denmark. An example of a publication of such a machine exists in DE 43 01 124 A1.

In a water-hydraulic machine, water is used as a hydraulic medium. Compared with the normally used hydraulic oils, water has the advantage that leakages causes practically no pollution of the environment.

However, water has the disadvantage that, contrary to oil, it has no lubricating properties. In a water-hydraulic machine, this usually leads to problems, as mutually movable parts cannot be lubricated and cooled to a sufficient extent.

Therefore, in the Nessie project mentioned above, when working with pairings of two mutually movable parts, one part has been provided with a layer or an insert of a plastics material, which is made of a friction-reducing plastics material. A preferred plastic material for this purpose comes from the group of high-performance thermoplastic plastics materials on the basis of polyarylether ketones, in particular polyetherether ketones (PEEK). Basically, the use of PEEK has turned out to be successful. Water-hydraulic machines provided with such a plastics material on the contact surface of mutually movable parts could also be operated reliably with water over long periods.

However, in one specific application, problems sometimes occur, when demineralised water is used as hydraulic fluid. Such applications comprise, for example, systems working according to the principle of reverse osmosis. As soon as "pure" water is used, wear phenomenon occur on mutually moving parts, particularly, when these parts are provided with PEEK.

The invention is based on the task of enabling operation of a water-hydraulic machine also with demineralised water.

SUMMARY OF THE INVENTION

In a water-hydraulic as mentioned in the introduction, this task is solved in that a layer of a carbon-containing material is arranged between the plastics material and the other part.

Thus, the plastics material, for example PEEK, is not replaced by another plastics material. On the contrary, an additional layer of a carbon-containing material is used, which is arranged between the plastics material and the other part. In connection with demineralised water, the use of such carbon-containing layers leads to astonishing results. The wear of the plastics material layer and the layer sliding upon it, for example a steel layer, is drastically reduced. The life of the machine is substantially extended. At the same time, the working characteristics of a water-hydraulic machine with this equipment does practically not change compared with the machines already known from the Nessie project. The reason for the improvement during operation with demineralised water, when using a layer of a carbon-containing material, is not yet fully disclosed. It is assumed that, further to an improved "lubrication ability" caused by the layer, also an improved corrosion protection occurs. This is particularly important in connection with the use of demineralised water as hydraulic fluid.

Preferably, the layer is arranged on the other part. In other words, two materials with friction-reducing properties are made to work together, namely, firstly, the plastics material, which already has friction-reducing properties, and secondly the layer of the carbon-containing material, which is arranged on the other part. This layer of carbon-containing material will protect the other part. At the same time, a mutual movement of the two parts will cause a minor wear away of the layer with a consequent settling on the plastics material.

Preferably, the layer is made on the basis of diamond-like carbon. Such a layer of "DLC" (diamond-like carbon) has outstanding frictional properties on the corresponding counter-surface, that is, it keeps the wear small. This particularly applies, when the DLC layer cooperates with the plastics material. An improvement can hardly be anticipated, as the plastics material, particularly PEEK, has already outstanding frictional coefficients. With demineralised water, however, the DLC layer even further improves these.

Preferably, the layer is applied during a plasma-activated steam-phase deposit. Thus, relatively thin layers can be achieved. At the same time occurs a very close connection of the diamond-like carbon with the base, so that even with heavy loads the risk of a detachment of the DLC-layer from the base is extremely small. The use of a steam-phase deposit, particularly a plasma-activated steam-phase deposit, permits the application of the diamond-like carbon practically independently of the shape of the base. This gives a relatively high degree of freedom when designing the mutually movable parts.

Preferably, the layer has a thickness in the range from 0.5 to 10 μm. The exact thickness depends on the desired load. The use of a very thin layer has the advantage that the base, that is, the surface of the other part, is practically identically reproduced. When designing the mutually movable parts, the layer of diamond-like carbon requires practically no attention at all. Still, however, the frictional properties and the wear properties are reduced so much that even with demineralised water a long life is ensured.

Preferably, the layer has a temper of 25 Gpa. Such a temper permits a relatively high loadability. Thus, also with higher pressure and the use of demineralised water, the wear is kept low.

Preferably, the plastics material is chosen from a group of the high-performance thermoplastic plastics materials on the basis of polyarylether ketones, in particular polyetherether ketones, polyamides, poly-acetalenes, polyarylethers, polyethyleneterephthalates, polyphenylene sulphides, polysulphones, polyether-sulphones, polyetherimides, polyamidimides, polyacrylates, phenol resins, such as novolak resins, or similar substances; glass, graphite, polytetra-fluoroethylene or carbon, particularly in fibre form, can be used as fillers. With this selection of material, already now the use of water as hydraulic fluid provides excellent working characteristics. When using demineralised water or pure water, this working characteristics will be maintained, on condition that a layer of a carbon-containing material, particularly a diamond-like carbon, is used on the other part.

Preferably, one of the two parts is a cylinder with a sleeve of the plastics material and the other of the two parts is a piston, provided with the layer, at least on its friction surface. The pairing cylinder-piston is one of the heaviest loaded elements, for example in an axial or radial piston machine. Here, the combination of the friction-reducing plastics material and the DLC-layer is particularly effective to keep the wear small when using demineralised water.

Alternatively, or additionally, one of the two parts is a holddown plate, which is supported on a cylinder drum via a ball joint, one sliding surface of the ball joint being provided with the plastics material, the other sliding surface having the layer. Also in the area of the ball joint, with which the holddown plate is supported on the cylinder drum, substantial loads occur. These loads can then be absorbed without problems, when one sliding surface is provided with the plastics material, for example PEEK, and the other sliding surface with a DLC-layer.

It is also preferred that one of the two parts is a sliding shoe, which bears on a swashplate and carries the plastics material, the swashplate, which is the other of the two parts, being provided with the layer. Of course, the embodiment can also be vice versa, that is, the swashplate is provided with the plastics material, and the sliding shoe carries the layer. Here, the material pairing is also particularly important, as the sliding shoes are pressed against the swashplate with relatively high pressures.

Finally, it is preferred that one of the two parts is a pressure plate, which is arranged between a control plate, being the other of the two parts, and the cylinder drum, and which turns during operation together with the cylinder drum in relation to the control plate, the control plate being provided with the plastics material and the pressure plate having the layer. Also in this area substantial loads occur, which can be absorbed by the DLC-layer, when demineralised water is used as hydraulic fluid, without causing any deterioration of the working characteristics of the machine.

Preferably, the sliding shoe is connected with the piston via a ball joint, and, at least in the area of the ball joint, provided with the plastics material, the counter-surface of the ball joint having the layer. The load of the ball joint on the sliding shoe is somewhat smaller than the load of the ball joint, with which the holddown plate is supported on the cylinder drum. Anyway, the result when using demineralised water is an advantageous material pairing of the plastics material with friction-reducing properties and the DLC layer.

Preferably, the cylinder drum is supported on a housing via a radial bearing surface, the cylinder drum having the layer and the bearing surface carrying the plastics material. Applying the layer on the cylinder drum is somewhat simpler than applying the layer on an inner surface of the housing.

BRIEF DESCRIPTION OF THE DRAWINGS

In the following, the invention is explained in detail on the basis of preferred embodiments in connection with the drawings, showing.

DETAILED DESCRIPTION OF THE PREFERRED EMBODIMENTS

Figure 1:
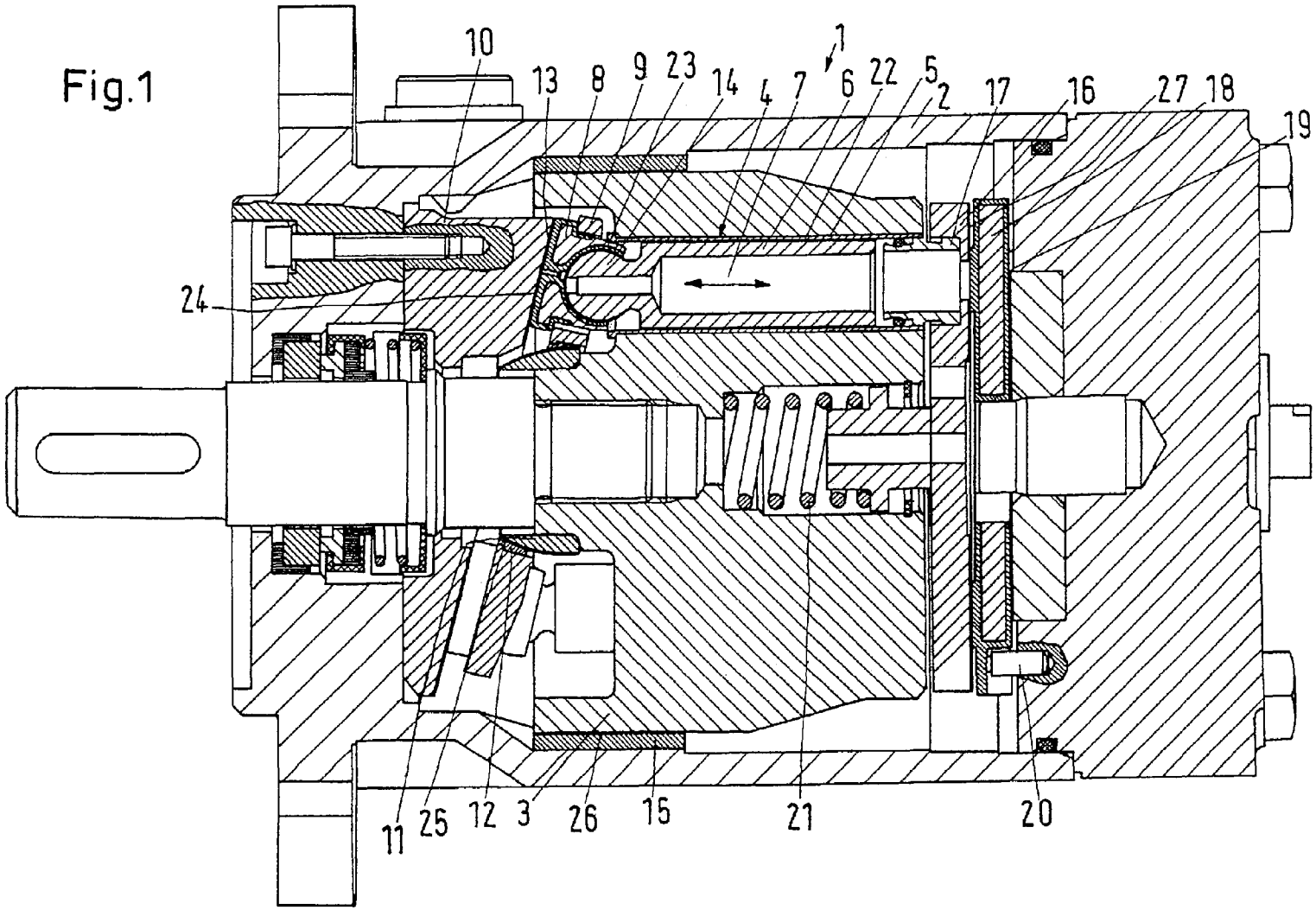
FIG. 1 a first embodiment of a water-hydraulic machine

FIG. 1 shows a water-hydraulic machine 1 with a housing 2, in which a cylinder drum 3 is arranged to be rotatable.

In the cylinder drum 3 is arranged at least one cylinder 4, which is surfaced with a sleeve 5. The sleeve 5 is made of a plastics material from the group of high-performance thermoplastic plastics materials on the basis of polyarylether ketones, in the present case polyetherether ketones (PEEK). PEEK cooperates in a low-friction manner with the material of a piston 6, which is in the present case made of stainless steel.

The piston 6 is movable in the cylinder drum in the direction of a double arrow 7. The control of the piston 6 movements in the cylinder 4 occurs by means of a sliding shoe 8, which is held against a swashplate 10 by the effect of a holddown plate 9.

The holddown plate 9 is supported on the cylinder drum 3 via a ball joint with one ball 11. The ball 11 is also made of stainless steel. In the contact area with the ball 11, the holddown plate 9 has an insert 12 made of PEEK.

The sliding shoe 8 is encased by a moulded element 13 made of PEEK, that is, the moulded element 13 forms both the bearing surface of the sliding shoe 8 on the swashplate 10 and the bearing surface of the sliding shoe 8 on the holddown plate 9. Finally, the moulded element 13 has an extension, which permits it to encase a ball 14 at the front end of the piston 6, this ball 14 forming a part of a ball joint.

The cylinder drum 3 is supported in the housing 2 on a bearing surface 15 made of PEEK, that is, the bearing surface 15 forms a radial bearing.

At the end facing away from the swashplate 10 is provided a pressure plate 16, into which sleeves 17 are inserted, which form a connection between the pressure plate 16 and the cylinders 4. The pressure plate 16 bears on a control plate 18, which is provided with a cover 19 made of PEEK. The control plate 18 is arranged to be fixed in the housing 2. Here, a bolt 20 retains it. The pressure plate 16 rotates together with the cylinder drum 3 in relation to the control plate 18, so that the control plate 18, can position the inlet and outlet of hydraulic fluid for the cylinder 4 correctly.

The pressure plate 16 is pressed against the control plate 18 by the force of a spring 21. The sleeves 17 permit a slight axial movement of the cylinder drum 3 in relation to the pressure plate 16. At the same time, the spring 21 provides a certain pressure, with which the holddown plate 9 presses the sliding shoe 8 against the swashplate 10.

In principle, such a machine is known. It can both be used as a motor, when the cylinder 4 is supplied with pressurised hydraulic fluid, and as a pump, when the movement of the piston 6 in the cylinder 4 produces a certain pressure in the hydraulic fluid. Due to the use of PEEK in the areas, where two parts of the machine 1 are mutually moving, it is even possible to operate the machine with water as hydraulic fluid. The plastics material PEEK reduces the friction between mutually movable parts to such a degree that a serious wear no longer exists.

When, however, this machine is operated with demineralised water, additional measures must be taken, which are explained in the following.

The surfaces bearing on the PEEK surfaces are namely provided with a layer of a diamond-like carbon. Such a DLC layer, the abbreviation "DLC" meaning "diamond-like carbon", has an extremely high temper, which is in the range of 3,000 HV or can be measured in the range of 2,000 to 5,000 kg/mm$^2$. In another notation, the temper is at least 25 Gpa.

Such a DLC layer can, for example, be applied on the corresponding parts during a plasma-activated steam-phase deposit. Such a layer is extremely thin. Its thickness is in the range from 0.5 to 10 μm. Thus, basically the surface geometry of the part carrying the DLC layer is not changed. The roughness of the layer is maintained. Anyway, this DLC layer, in cooperation with the PEEK plastics material, provides a relatively small friction between the mutually movable parts, also when demineralised water is used as hydraulic fluid. This friction ensures a reliable protection against the wear of the mutually movable parts. Also when using demineralised water as hydraulic fluid, a satisfactory life is ensured.

On the friction surface cooperating with the sleeve 5, the piston 6 has a layer 22 of diamond-like carbon. In the area of the ball 14, the piston has an additional DLC layer 23. Of course, the two layers 22, 23 can also extend into one another.

On the swashplate 10 is arranged a DLC layer 24 in the contact area with the sliding shoes 8. The ball 11 of the ball joint between the holddown plate 9 and the cylinder drum has a layer 25, which cooperates with the insert 12 of PEEK. The cylinder drum 3 has a layer 26, with which it bears on the bearing surface 15.

Also at the other end of the cylinder drum 3 corresponding layers of diamond-like carbon are provided. This particularly concerns the pressure plate 16, which has a layer 27, which bears on the PEEK cover 19 of the control plate 18.

Figure 2:
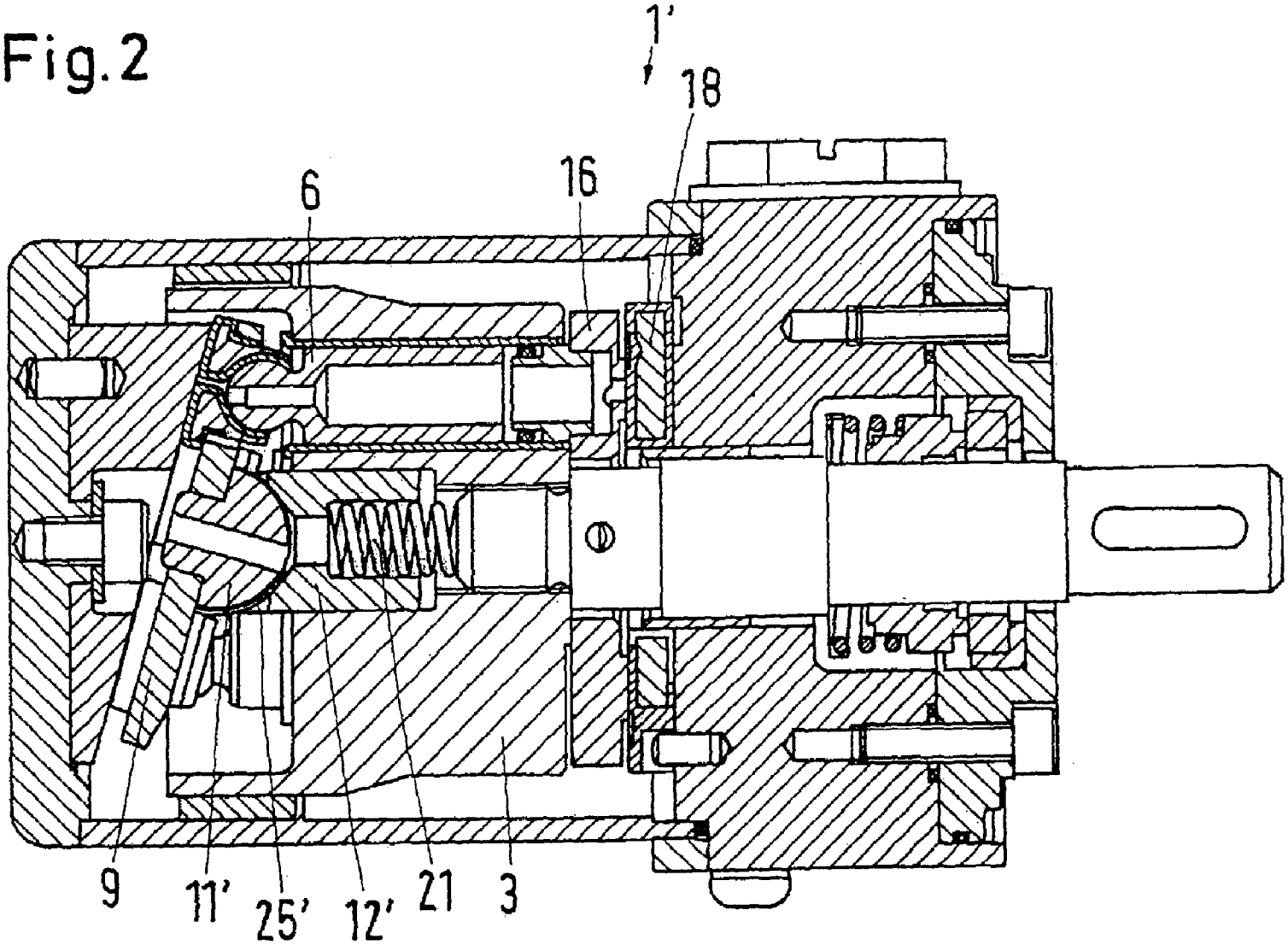
FIG. 2 a second embodiment of a water-hydraulic machine

FIG. 2 shows a similarly designed hydraulic machine 1', in which mainly the support of the holddown plate 9 on the cylinder drum 3 has changed. Same parts have the same reference numbers. Corresponding parts have marked reference numbers.

Here, the ball 11' is arranged in the holddown plate 9. The ball 11' bears on an insert 12', which is supported in the cylinder drum 3 under the effect of a spring 21. The insert 12' is made of a plastics material, particularly PEEK. The ball 11' carries the layer 25' of diamond-like carbon.

Figure 3:
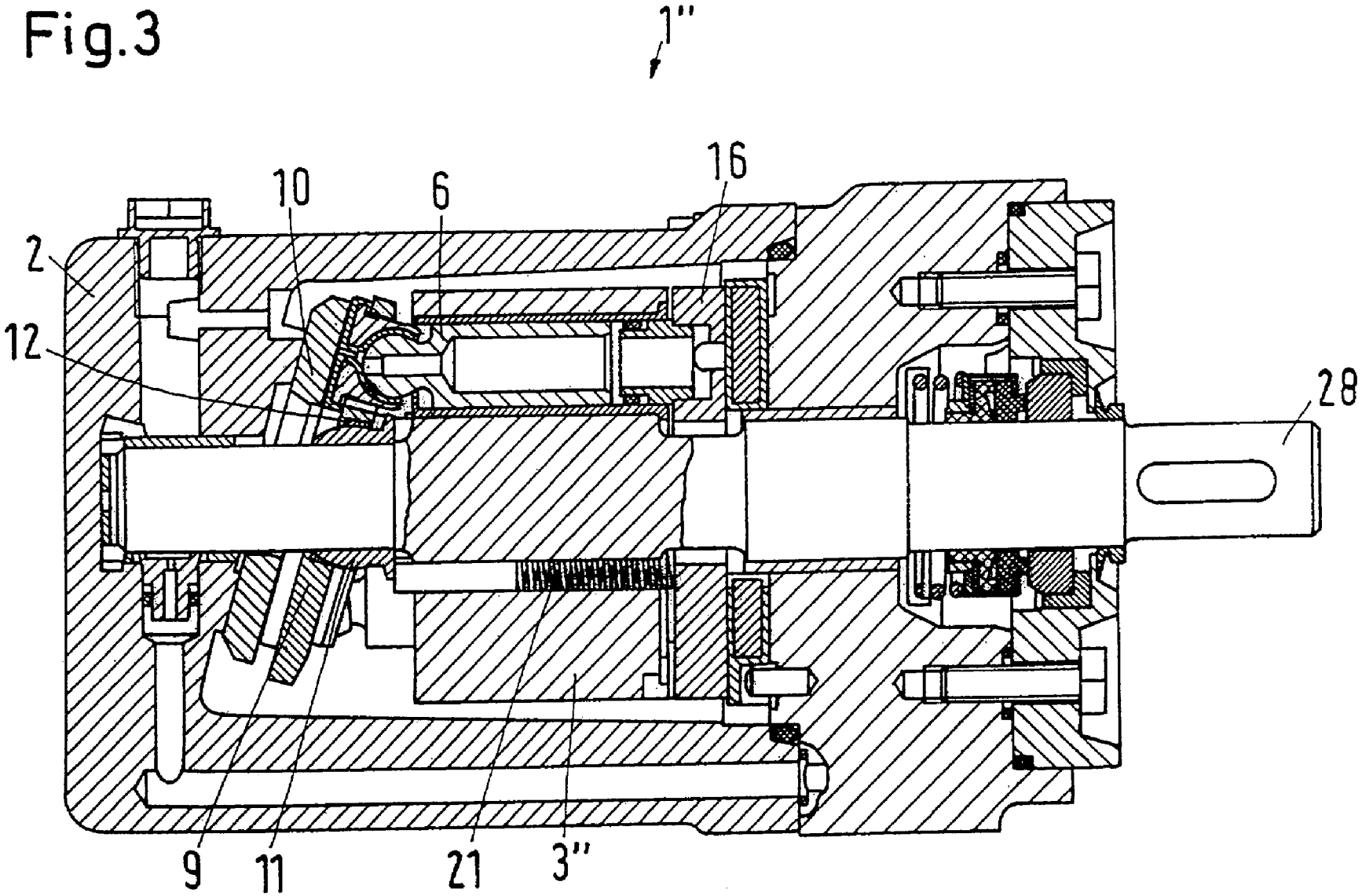
FIG. 3 a third embodiment of a water-hydraulic machine

FIG. 3 shows a further embodiment of a hydraulic machine 1", in which same parts as in FIG. 1 have the same reference numbers and corresponding parts have double marked reference numbers. Here, the cylinder drum 3" no longer bears on the housing 2. On the contrary, two ends of a shaft 28 are supported in the housing 2. Further, here the piston 6, the swashplate 10, the pressure plate 16 and the ball 11 are provided with a DLC layer in a manner as shown in FIGS. 1 und 2.

What is claimed is:

1. A water-hydraulic machine comprising:

at least a first and a second pair of mutually movable parts;

a surface formed of a plastic material having friction-reducing properties on one part of each pair; and a layer of a carbon-containing material arranged between the plastic material and the other part in each pair;

wherein at least one part of the second pair is of a different type than either part of said first pair.

2. The machine according to claim 1, wherein the layer of carbon-containing material is arranged on the other part of at least one pair.

3. The machine according to claim 1, wherein the layer of carbon-containing material is formed from a diamond-like carbon.

4. The machine according to claim 3, wherein the layer of carbon-containing material is applied during a plasma-activated steam-phase deposit.

5. The machine according to claim 1, wherein the layer of carbon-containing material has a thickness in the range from 0.5 to 10 μm.

6. The machine according to claim 1, wherein the layer of carbon-containing material has a temper of 25 Gpa.

7. The machine according to claim 1, wherein the plastics material is chosen from a group of the high-performance thermoplastic plastics materials consisting of polyarylether ketones, polyetherether ketones, polyamides, poly-acetalenes, polyarylethers, polyethyleneterephthalates, polyphenylene sulphides, polysulphones, polyether-sulphones, polyetherimides, polyamidimides, polyacrylates, phenol resins, novolak resins; and wherein glass, graphite, polytetrafluoroethylene or carbon, particularly in fibre form, can be used as fillers.

8. The machine according to claim 1, wherein the first pair of parts includes a sliding shoe and a swashplate, the sliding shoe bearing on the swashplate and carrying the plastics material, the swashplate being provided with the layer of carbon-containing material.

9. The machine according to claim 8, wherein the second pair of mutually movable parts includes the sliding shoe and a piston, the sliding shoe being connected with the piston via a ball joint, and, at least in the area of the ball joint, the sliding shoe is also provided with the plastics material, the counter-surface of the ball joint having another layer of carbon-containing material thereon.

10. The machine according to claim 1, wherein at least one part of each pair of mutually movable parts is formed from stainless steel.

11. The machine according to claim 1 wherein the first pair of parts includes a piston and a sliding shoe, the piston being formed with a ball and carrying the layer of carbon-containing material at least on the ball, and the sliding shoe formed to accommodate the ball and carrying the plastic material.

12. The machine according to claim 11, wherein the ball is metal.

13. A machine comprising:

at least two mutually movable parts;

a surface formed of a plastic material having friction-reducing properties on one part; and a layer of a carbon-containing material arranged between the plastic material and the other part;

wherein one of the two parts is a holddown plate, which is supported on a cylinder dram via a ball joint one sliding surface of the ball joint being provided with the plastics material, another sliding surface having the layer of carbon-containing material thereon.

14. The machine according to claim 13, wherein the cylinder drum is supported on a housing via a radial bearing surface, the cylinder drum having the layer of carbon-containing material thereon and the bearing surface carrying the plastics material.

15. A machine comprising:

at least two mutually movable parts;

a surface formed of a plastic material having friction-reducing properties on one part; and a layer of a carbon-containing material arranged between the plastic material and the other part;

wherein one of the two parts is a sliding shoe, which bears on a swashplate and carries the plastics material, the swashplate, which is the other of the two parts, being provided with the layer of carbon-containing material; and wherein the sliding shoe is kept bearing on the swashplate by means of a holddown plate, the holddown plate carrying another layer of carbon-containing material thereon.

16. A machine comprising:

at least two mutually movable parts;

a surface formed of a plastic material having friction-reducing properties on one part; and a layer of a carbon-containing material arranged between the plastic material and the other part;

wherein both of the at least two mutually movable parts are formed from stainless steel.

17. A machine comprising:

at least two mutually movable parts;

a surface formed of a plastic material having friction-reducing properties on one part; and a layer of a carbon-containing material arranged between the plastic material and the other part;

wherein the at least two mutually movable parts include a piston and a sliding shoe, the piston being formed with a ball, and carrying the layer of carbon-containing material at least on the ball, and the sliding shoe formed to accommodate the ball and carrying the plastic material; and wherein another two mutually movable parts include the piston and a cylinder, the piston moving within the cylinder, the cylinder also carrying the plastic material and the piston carrying another layer of carbon-containing material, at least where the piston touches the plastic material carried by the cylinder.

* * * * *